US012758078B2

(12) United States Patent
Zhou et al.

(10) Patent No.: US 12,758,078 B2
(45) Date of Patent: Oct. 13, 2026

(54) DOUBLE-LAYER MOP BUCKET FOR FLAT MOP

(71) Applicant: Zhejiang Meitianle Home Furnishing Co., Ltd., Jinhua (CN)

(72) Inventors: Weiming Zhou, Jinhua (CN); Henghui Hu, Jinhua (CN)

(73) Assignee: Zhejiang Meitianle Home Furnishing Co., Ltd., Jinhua (CN)

( * ) Notice: Subject to any disclaimer, the term of this patent is extended or adjusted under 35 U.S.C. 154(b) by 107 days.

(21) Appl. No.: 18/908,871

(22) Filed: Oct. 8, 2024

(65) Prior Publication Data

US 2025/0302269 A1 Oct. 2, 2025

(30) Foreign Application Priority Data

Apr. 1, 2024 (CN) ..... 202410388897.3

(51) Int. Cl.
*A47L 13/58* (2006.01)
*A47L 13/03* (2006.01)

(52) U.S. Cl.
CPC ..... *A47L 13/58* (2013.01); *A47L 13/03* (2013.01)

(58) Field of Classification Search
CPC ..... A47L 13/03; A47L 13/08; A47L 13/28; A47L 13/59; A47L 13/60; A47L 13/502; B65D 1/36; B65D 81/3216
USPC ..... 220/23.83
See application file for complete search history.

(56) References Cited

FOREIGN PATENT DOCUMENTS

| | | | | | |
|---|---|---|---|---|---|
| CN | 109330521 | A | * | 2/2019 | ..... A47L 13/58 |
| CN | 113974513 | A | * | 1/2022 | ..... A47L 13/58 |
| CN | 215534103 | U | | 1/2022 | |
| CN | 114532928 | A | * | 5/2022 | ..... A47L 13/58 |
| CN | 217186020 | U | | 8/2022 | |
| CN | 219814040 | U | * | 10/2023 | ..... A47L 13/58 |
| JP | 3236322 | U | * | 2/2022 | ..... A47L 13/60 |

OTHER PUBLICATIONS

CN-109330521 Espacenet Translation; A Mop Cleaning Barrel; Zeng, Yun-bing; Feb. 15, 2019 (Year: 2019).*
CN-114532928 Espacenet Translation; A Cleaning Tool; May 27, 2022 (Year: 2022).*
JP-3236322 Espacenet Translation; A Mop Cleaning Device That Can Remove Dirt And Drain Water; Feb. 10, 2022 (Year: 2022).*

(Continued)

*Primary Examiner* — Brian D Keller
*Assistant Examiner* — Sidney D Full
(74) *Attorney, Agent, or Firm* — Jose Cherson Weissbrot

(57) ABSTRACT

A double-layer mop bucket for a flat mop comprises an outer bucket provided with a clean water area and a sewage area, an inner bucket arranged in the sewage area and capable of inserting the flat mop, and a cover body component removably mounted on the outer bucket, wherein a cleaning area and a scraping area which are connected are arranged in the inner bucket, a cleaning port connected with the cleaning area and a scraping port connected with the scraping area are arranged on the cover body component, a groove for limiting the flat mop to be inserted into the bottom is arranged at the bottom of the inner bucket, and a water guiding chute capable of guiding water scraped at the scraping port and the cleaning port to flow into the sewage area is arranged in the cover body component.

15 Claims, 19 Drawing Sheets

(56) References Cited

OTHER PUBLICATIONS

CN-113974513 Espacenet Translation; A Water-saving Mop Cleaning Device; Yu, Ling-hui; Jan. 28, 2022 (Year: 2022).*
CN 219814040 Espacenet Translation; Double-bucket Mop Bucket; Huang, Qiu-zhi; Oct. 10, 2023 (Year: 2023).*

* cited by examiner

A

B

C

D

E

A-A

DOUBLE-LAYER MOP BUCKET FOR FLAT MOP

TECHNICAL FIELD

The invention belongs to the technical field of a mop bucket, relates to a mop bucket for a flat mop, in particular to a double-layer mop bucket for a flat mop.

BACKGROUND ART

Flat mop is a kind of mop capable of cleaning by touching the ground through the flat surface. Usually, a replaceable and absorbent cloth is attached to the bottom of the flat mop for mopping. Some flat mops are often equipped with mop buckets to avoid touching the mop head during cleaning. The mop head of the flat mop is inserted or lifted in the mop bucket to realize the cleaning.

For example, the patent with authorized announcement number CN215534103U discloses a flat mop cleaning kit, in which the mop head of the flat mop is always inserted into the inner bucket during water supply and scraping, and needs to act up and down for water supply and scraping in the inner bucket.

However, water generated by cleaning or scraping the mop head still flows into the inner bucket, so that the mop head is contaminated with the sewage in the inner bucket when acting downward and scraping, and the mop cleaning is not in place.

SUMMARY OF THE INVENTION

Aiming at the problem that the existing flat mop is not cleaned in place when being cleaning through the mop bucket, the invention provides a double-layer mop bucket for a flat mop for ensuring the cleanliness by groove arrangement and drainage during scraping.

In order to solve the above technical problems, the invention adopts the following technical proposal:

- A double-layer mop bucket for a flat mop comprises an outer bucket, an inner bucket arranged in the outer bucket for the flat mop to be inserted, a cover body component removably mounted on the outer bucket, and a water supply component mounted on the cover body component and inserted into the outer bucket;
- A clean water area and a sewage area are arranged in the outer bucket, and the inner bucket is removably installed in the sewage area, and the water supply component is inserted into the clean water area;
- A cleaning area and a scraping area are arranged in the inner bucket, and the cleaning area and the scraping area are connected, and a groove for limiting the flat mop to be inserted into the bottom is arranged at the bottom of the inner bucket;
- A cleaning port for inserting the flat mop into the cleaning area and a scraping port for inserting the flat mop into the scraping area for scraping are arranged on the cover body component, and the flat mop can act on the water supply component for water supply when inserted into the cleaning area from the cleaning port;
- A water guiding chute is arranged in the cover body component, and can guide the water scraped from the flat mop during scrapping to flow into the sewage area.

The invention further adopts the following priority proposal: drainage ports are respectively arranged on the same side of the inner bucket and the outer bucket, and a locating plug is inserted into the two drainage ports, and restricts the separation of the inner bucket from the outer bucket.

The invention further adopts the following priority proposal: a pipe wall extended into the sewage area is arranged at the drainage port of the outer bucket, and a convex wall extended outward and capable of being erected on the pipe wall is arranged at the drainage port of the inner bucket.

The invention further adopts the following priority proposal: a waterproof ring is installed on the locating plug to restrict the leakage of the two drainage ports.

The invention further adopts the following priority proposal: the cover body component comprises an upper cover and a bottom plate fixedly arranged under the upper cover, and the cleaning port and the scraping port run through the upper cover and the bottom plate.

The invention further adopts the following priority proposal: a scraping plate capable of scraping the flat mop is arranged or installed on the bottom plate and is partially exposed to the scraping port.

The invention further adopts the following priority proposal: the water supply component comprises a double-barrel pipe fitting connected to the upper cover and inserted into the clean water area, a gear set mounted on the bottom plate and partially exposed to the cleaning port, a pull rod eccentrically rotating and connected with the gear set, a piston arranged in the double-barrel pipe fitting in a sliding way and rotationally connected with the pull rod, and two check valves installed in the double-barrel pipe fitting.

The invention further adopts the following priority proposal: the water supply component comprises a drive component and a discharge component, the drive component comprises a friction wheel rotationally arranged and a pull rod, the discharge component comprises a double-barrel pipe fitting connected to the upper cover and inserted into the clean water area, a piston hermetically slipping into one barrel of the double-barrel pipe fitting and two check valves installed in the double-barrel pipe fitting, one end of the pull rod is eccentrically rotated and connected to the friction wheel, and the other end of the pull rod is hinged with the piston.

The invention further adopts the following priority proposal: the friction wheel is locally located in the cleaning area, and is driven to rotate and drive the water supply component to supply water when the flat mop matched with the mop bucket is extended into the cleaning area.

The invention further adopts the following priority proposal: friction teeth for increasing the friction force are uniformly distributed on the outer ring wall of the friction wheel.

The invention further adopts the following priority proposal: The double-barrel pipe fitting is provided with a pipe body I, and a connecting pipe connected with the pipe body I is arranged on the upper cover.

The invention further adopts the following priority proposal: the double-barrel pipe fitting is also provided with a bottom pipe and a pipe body II, the pipe body I and the pipe body II are arranged in parallel and connected with the bottom pipe, the piston is arranged in the pipe body II in a sliding way, one check valve is arranged on the bottom pipe, and the other check valve is arranged in the pipe body I.

The invention further adopts the following priority proposal: a water guide plate located in the cleaning port and a connecting pipe connected with the pipe body I are arranged on the upper cover, a water retaining cover is installed on the upper cover, a cavity is formed between the water retaining cover and the water guide plate, and the connecting pipe is connected with the cavity.

Compared with the prior art, the invention has the following advantages: the sewage dripping at the cleaning port during water supply and cleaning of the flat mop enters the groove through the structure arrangement on the inner bucket and the cover body component, and the sewage and dirt scraped at the scraping port during scraping of the flat mop flows into the sewage bucket to ensure less sewage remaining in the inner bucket, and the flat mop does not come into contact with the sewage in the groove of the inner bucket when the flat mop works up and down at the cleaning port or the scraping port, thereby ensuring the cleanliness of the flat mop while the sewage in the inner bucket does not overflow the groove.

BRIEF DESCRIPTION OF THE DRAWINGS

The invention is further described in detail below in conjunction with drawings and preferred embodiments. However, technicians in the field will appreciate that these drawings are drawn solely for the purpose of explaining the preferred embodiments and therefore should not be used as a limitation to the scope of the invention. In addition, the drawings are intended only to conceptually represent the composition or construction of the objects described and may contain exaggerated indication unless specifically indicated, and they are not necessarily drawn to scale.

Figure 1:
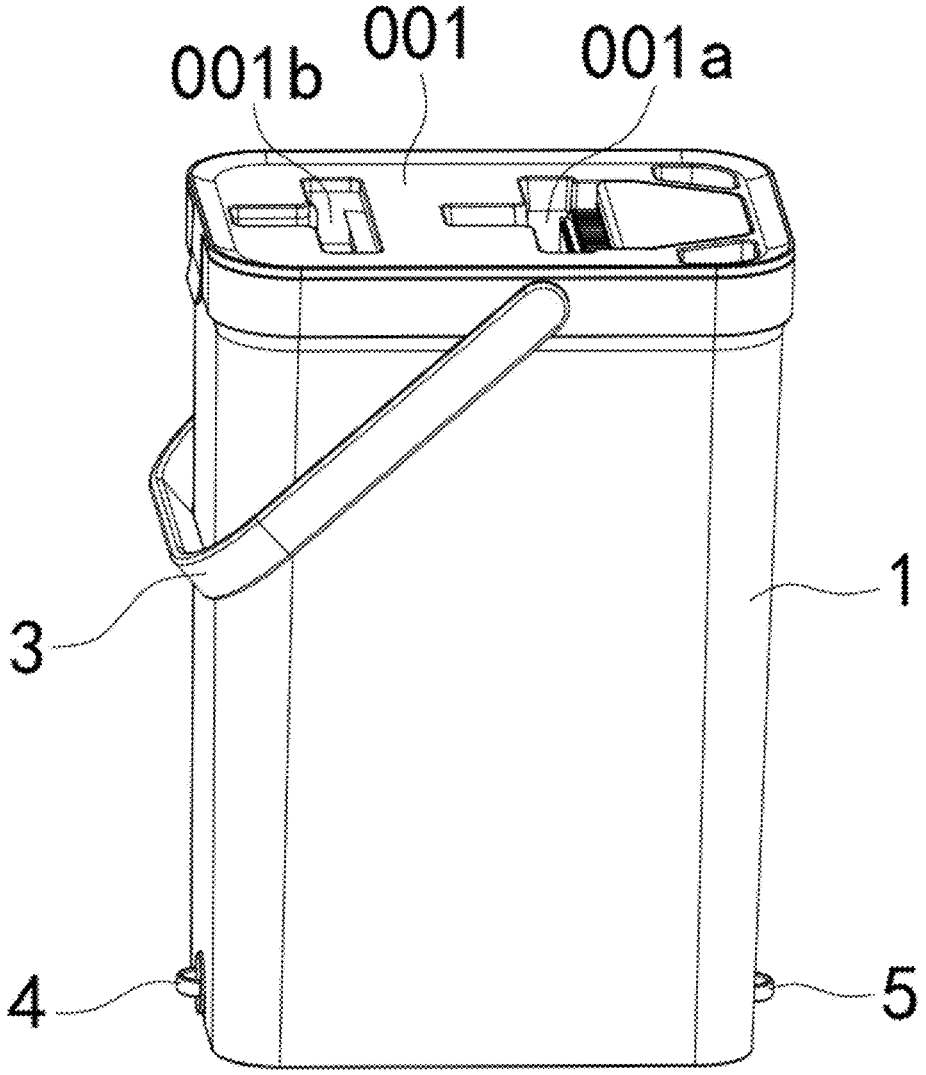
FIG. 1 is the structural diagram for the preferred embodiment 1 of the invention.
Figure 2:
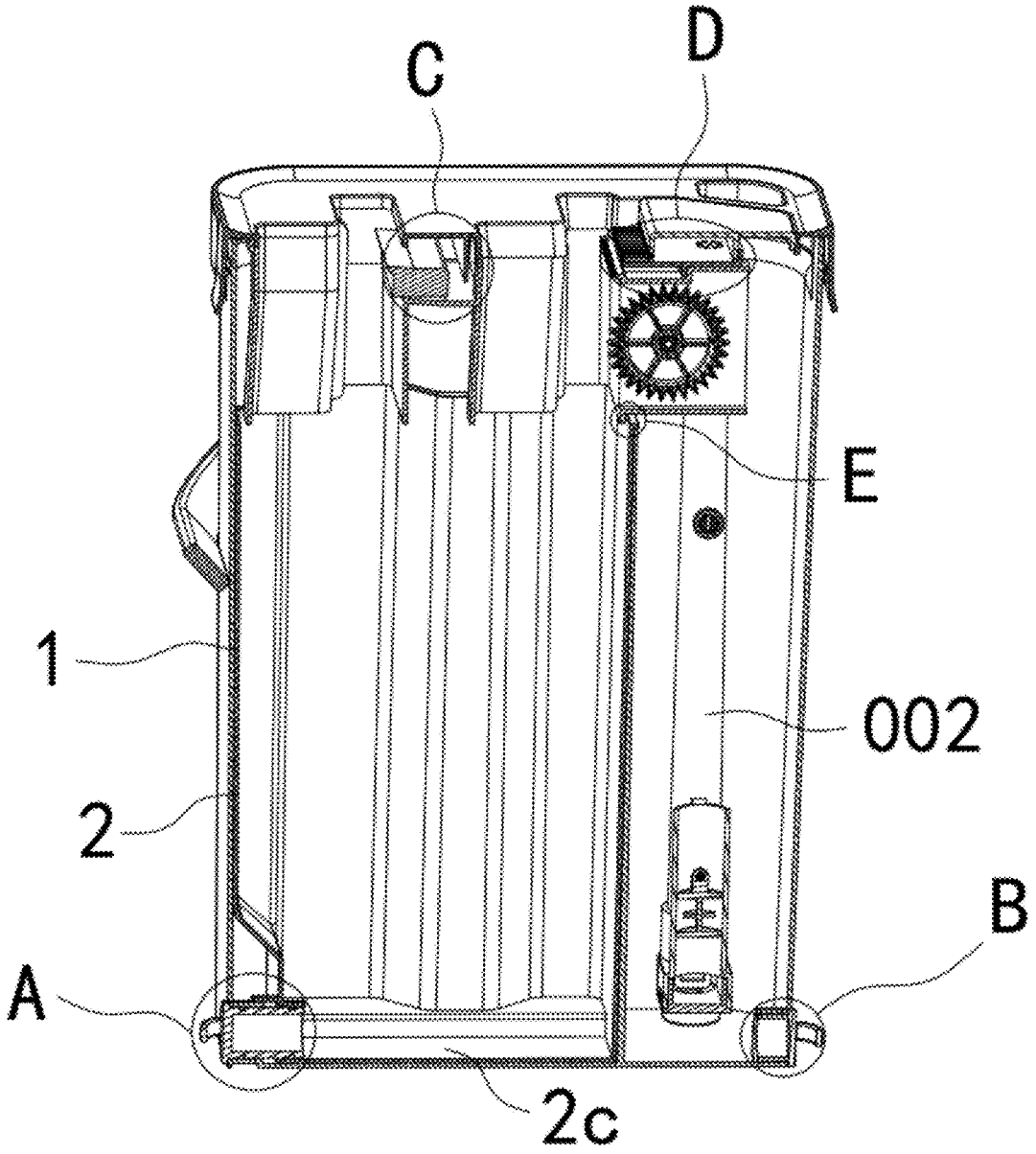
FIG. 2 is the section view 1 for the mop bucket in the preferred embodiment 1 of the invention.
Figure 3:
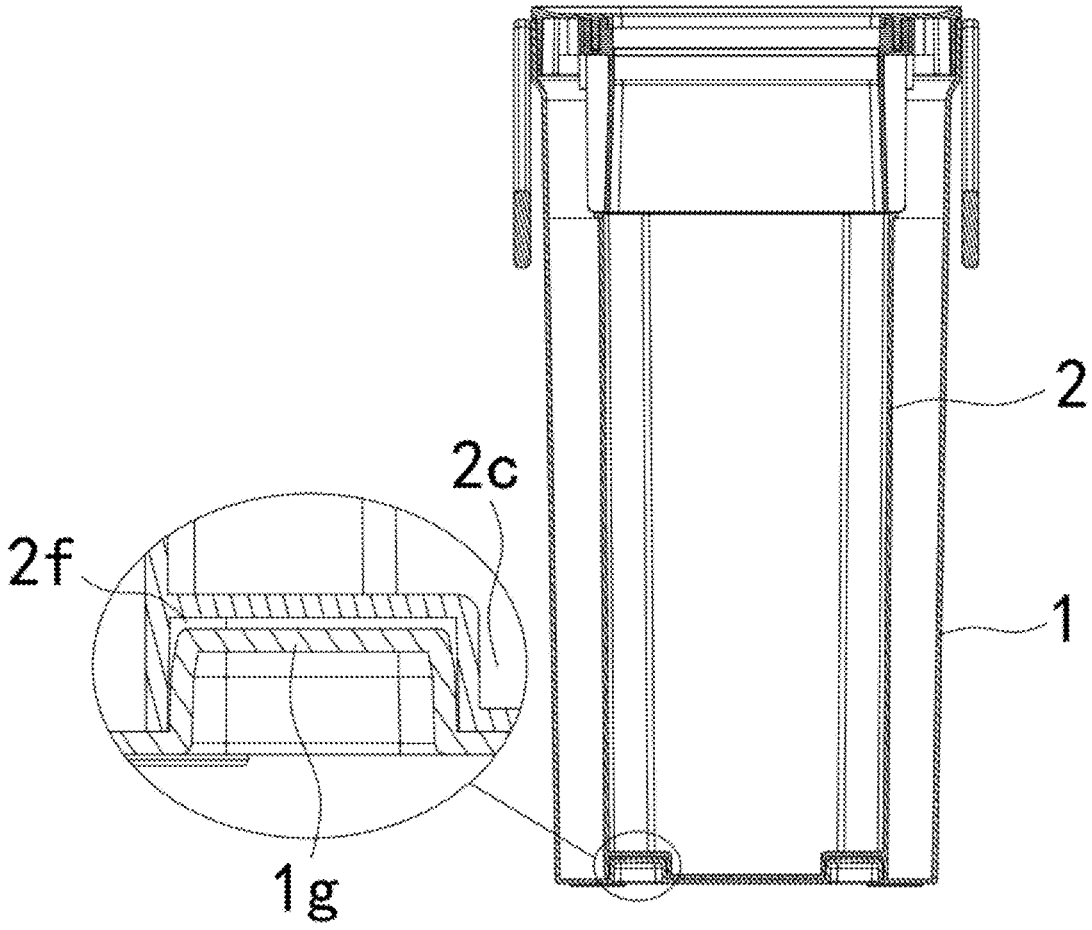
FIG. 3 is the section view 2 for the mop bucket in the preferred embodiment 1 of the invention.
Figure 4:
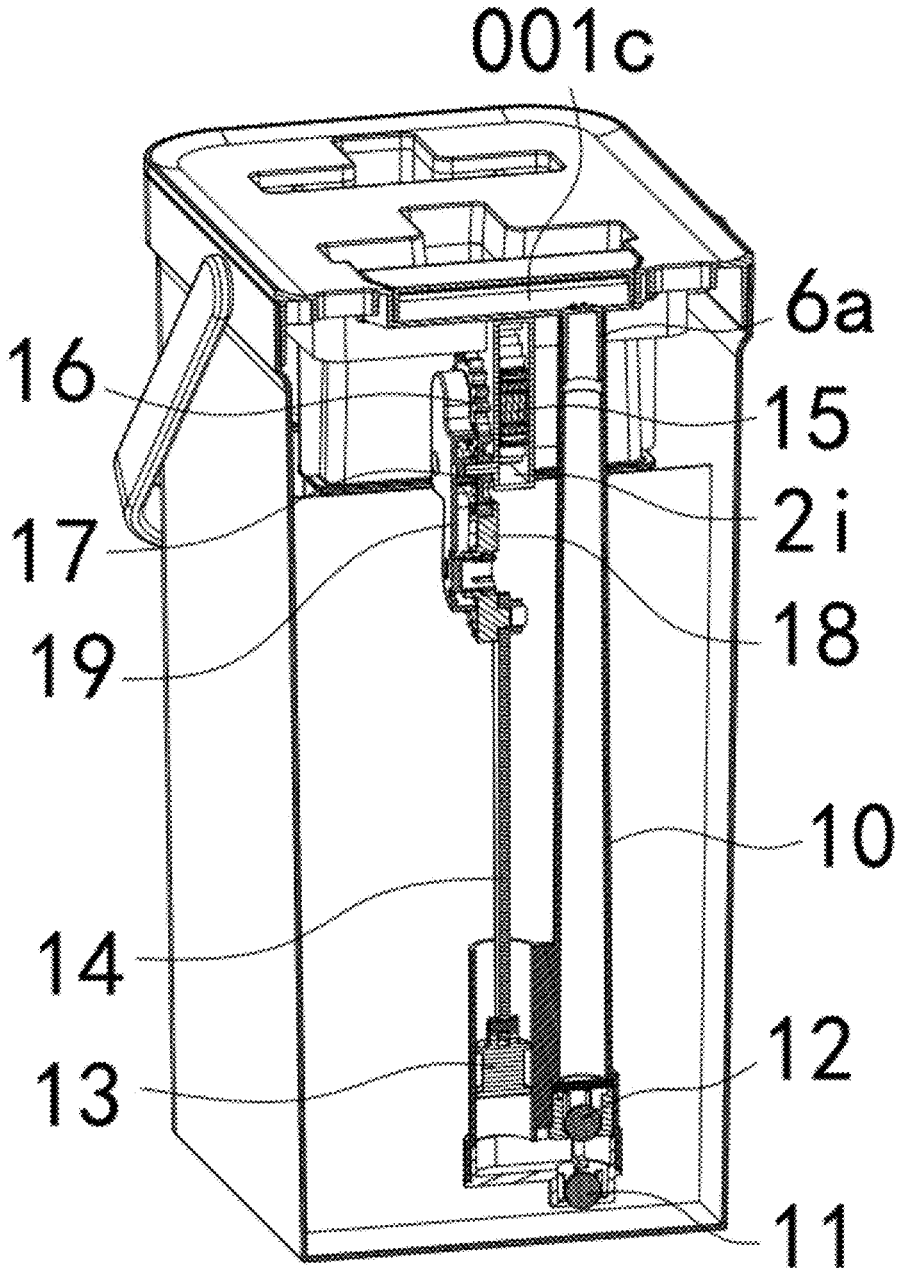
FIG. 4 is the section view 3 for the mop bucket in the preferred embodiment 1 of the invention.
Figure 5:
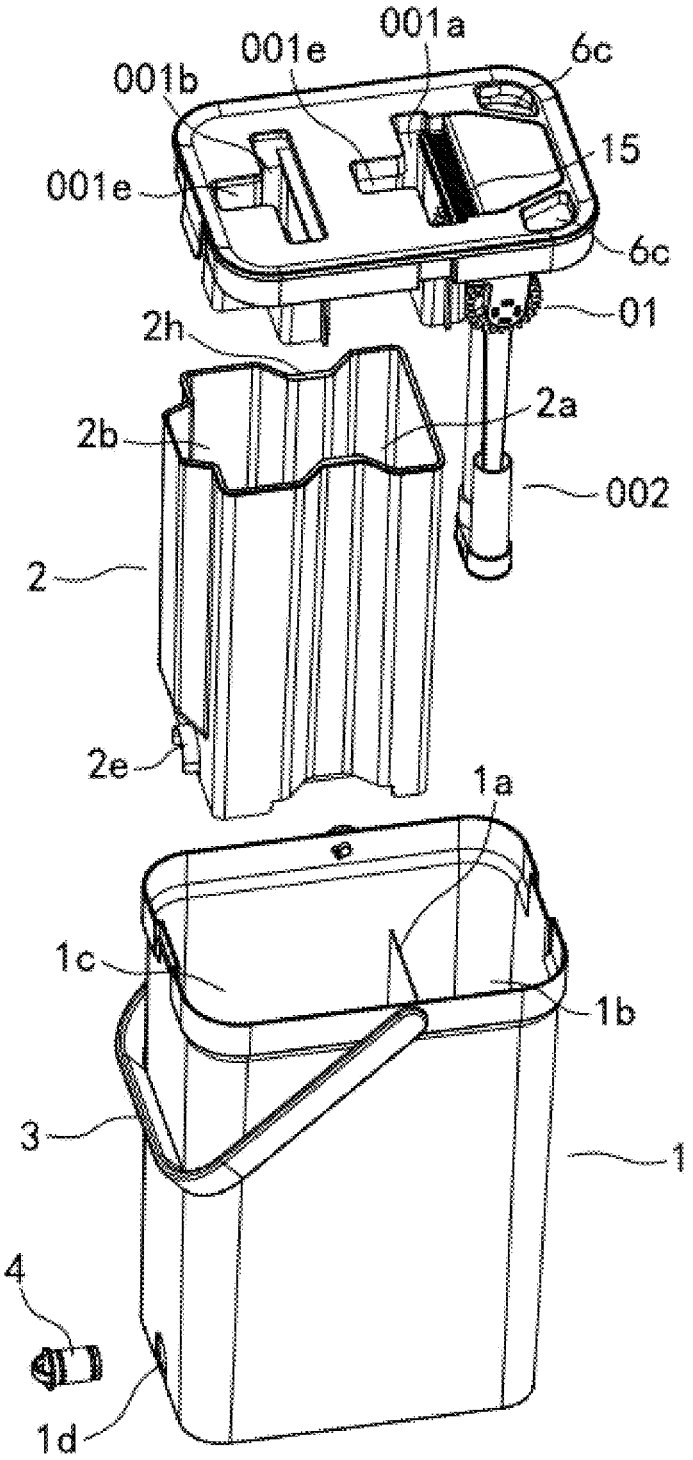
FIG. 5 is the explosive view for the mop bucket in the preferred embodiment 1 of the invention.
Figure 6:
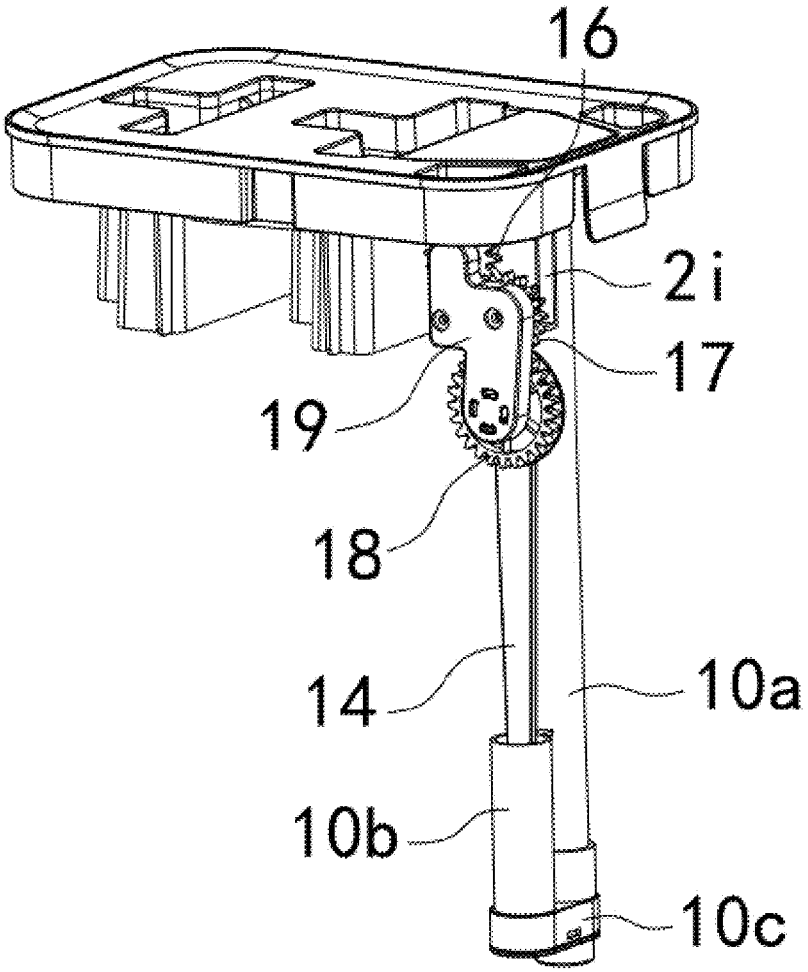
FIG. 6 is the structural diagram 1 for the preferred embodiment 1 of the invention when the cover body component is connected with the water supply component.
Figure 7:
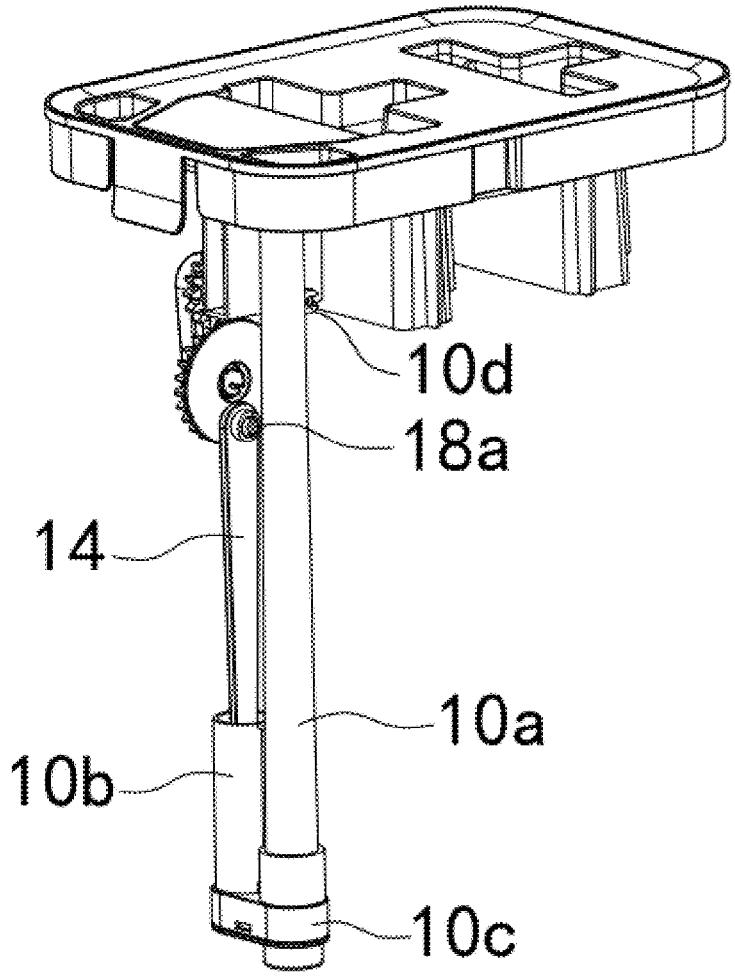
FIG. 7 is the structural diagram 2 for the preferred embodiment of the invention when the cover body component is connected with the water supply component.
Figure 8:
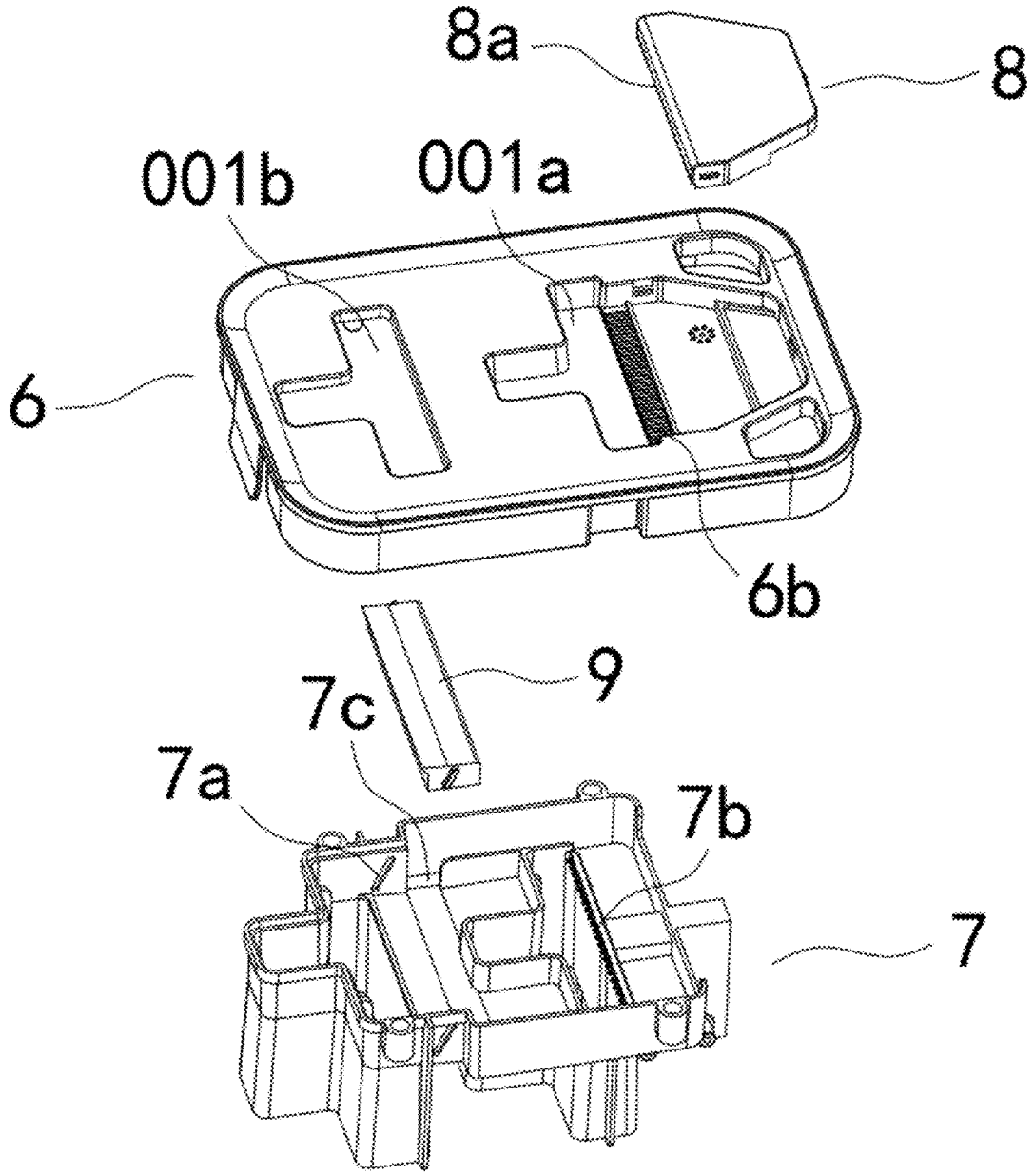
FIG. 8 is the explosive view for the cover body component in the preferred embodiment 1 of the invention.
Figure 9:
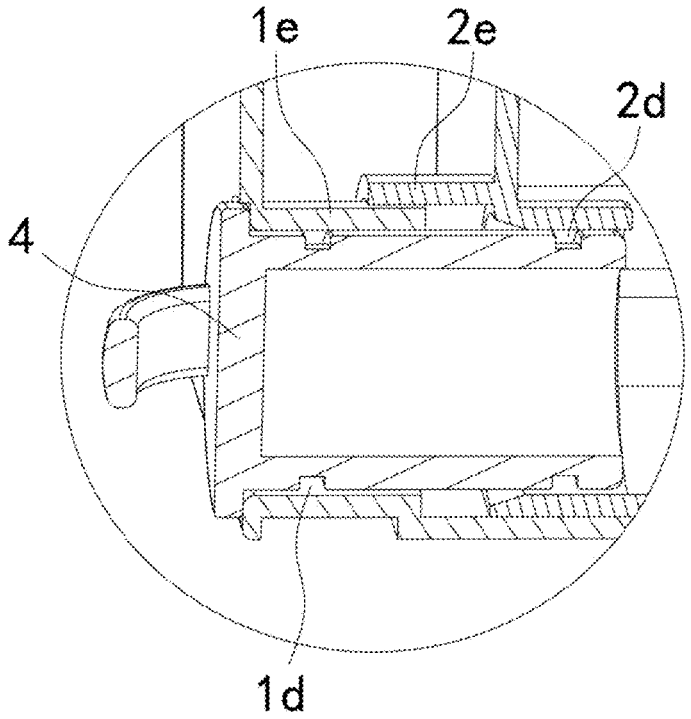
FIG. 9 is the enlarged view for Part A in FIG. 2 in the preferred embodiment 1 of the invention.
Figure 10:
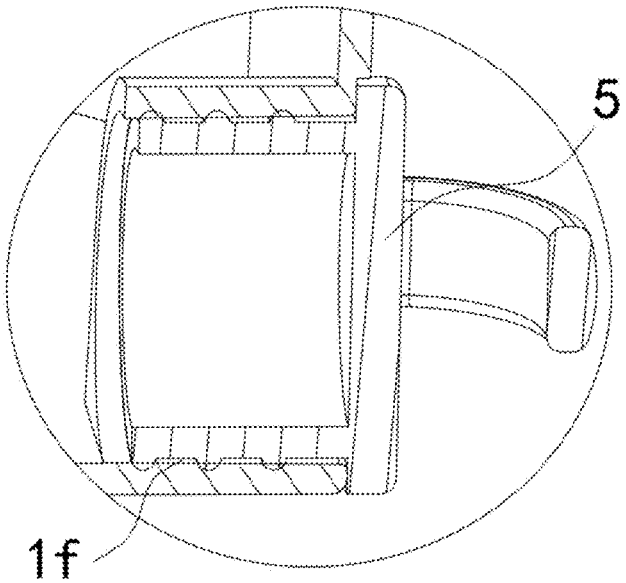
FIG. 10 is the enlarged view for Part B in FIG. 2 in the preferred embodiment 1 of the invention.
Figure 11:
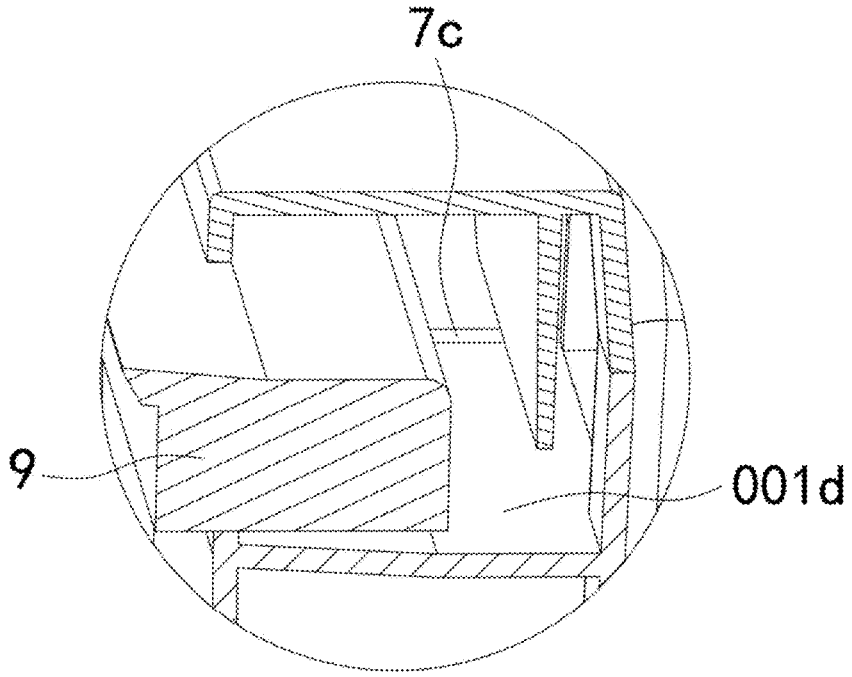
FIG. 11 is the enlarged view for Part C in FIG. 2 in the preferred embodiment 1 of the invention.
Figure 12:
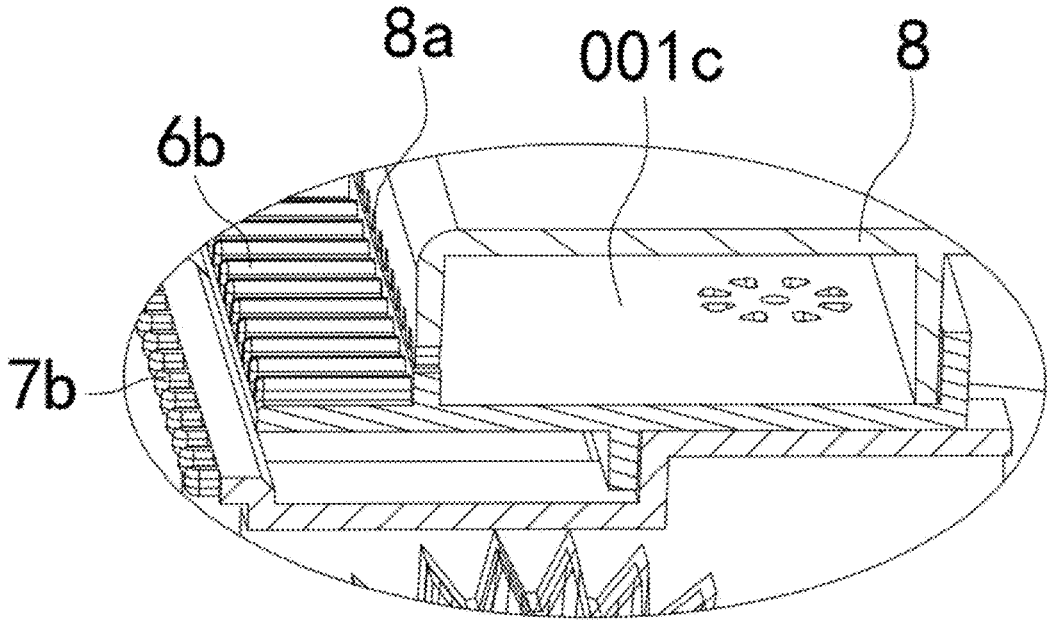
FIG. 12 is the enlarged view for Part D in FIG. 2 in the preferred embodiment 1 of the invention.
Figure 13:
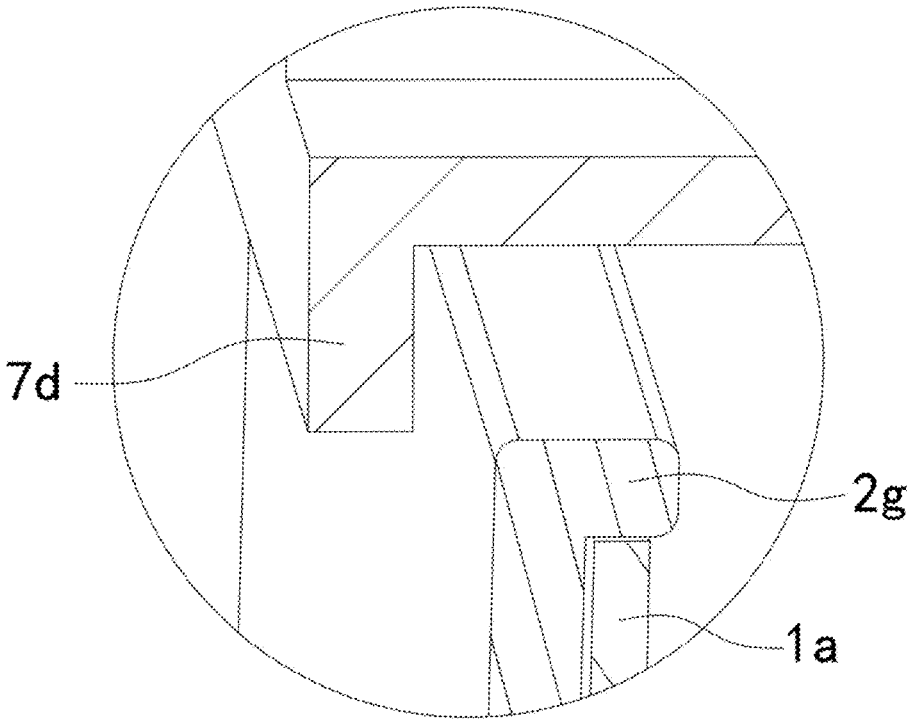
FIG. 13 is the enlarged view for Part E in FIG. 2 in the preferred embodiment 1 of the invention.

The names of the parts referred to by the reference signs in the drawings are as follows: 1. Outer bucket; 1*a*. Baffle plate; 1*b*. Clean water area; 1*c*. Sewage area; 1*d*. Drainage port 1; 1*e*. Pipe wall; 1*f*. Drainage port II; 1*g*. Step; 2. Inner bucket; 2*a*. Cleaning area; 2*b*. Scraping area; 2*c*. Groove; 2*d*. Drainage port III; 2*e*. Convex wall; 2*f*. Concave; 2*g*. Flange; 2*h*. Avoidance part; 2*i*. Mounting port; 3. Handle; 4. Locating plug; 5. Water plug; 001. Cover body component; 001*a*. Cleaning port; 001*b*. Scraping port; 001*c*. Cavity; 001*d*. Water guiding chute; 001*e*. Avoidance port; 6. Upper cover; 6*a*. Connecting pipe; 6*b*. Water guide plate; 6*c*. Water filling port; 6*d*. Intercepting strip; 6*e*. Mounting pipe; 6*f*. Outlet hole; 7. Bottom plate; 7*a*. Sliding chute; 7*b*. Tooth plate part; 7*c*. Drain outlet; 7*d*. Lower edge; 7*e*. Sewage guide ring groove; 7*f*. Sewage guide port; 7*g*. Connecting block; 8. Water retaining cover; 8*a*. Through hole; 9. Scraping plate; 002. Water supply component; 10. Double-barrel pipe fitting; 10*a*. Pipe body I; 10*b*. Pipe body II; 10*c*. Bottom pipe; 10*d*. Fixing part; 10*e*. Mounting block; 11. Check valve 1; 12. Check valve II; 13. Piston; 14. Pull rod; 01. Gear set; 15. Active gear; 16. Driven gear; 17. Intermediate gear; 18. Eccentric gear; 18*a*. Eccentric shaft; 19. Fixing plate; 20. Friction wheel; 20*a*. Friction teeth; 21. Rotating shaft; 22. Indicating impeller.

DETAILED DESCRIPTION OF THE INVENTION

The invention is further described in detail in combination with the drawings and embodiments.

Embodiment 1

As shown in FIG. 1 to FIG. 13, a double-layer mop bucket for a flat mop comprises an outer bucket 1, a removable inner bucket 2 located in an outer bucket 1, a locating plug for connecting the outer bucket 1 and the inner bucket 2, a cover body component 001 removably covered on the outer bucket 1, and a water supply component 002 installed on the cover body component 001 and inserted into the outer bucket 1; a handle 3 is usually rotationally installed on the outer bucket 1 and facilitates to lift and handle the mop bucket.

In the embodiment, a baffle plate 1*a* is arranged in the outer bucket 1 and divides the outer bucket 1 into a clean water area 1*b* and a sewage area 1*c*, the inner bucket 2 is placed in the sewage area 1*c*, the locating plug 4 is simultaneously inserted into the outer bucket 1 and the inner bucket 2 to limit the separation of the inner bucket 2 from the outer bucket 1, the water supply component 002 is inserted into the clean water area 1*b*, a cleaning port 001*a* and a scraping port 001*b* are provided on the cover body component 001, the cleaning port 001*a* and the scraping port 001*b* are located above the inner bucket 2, the cleaning port 001*a* corresponds to the cleaning area 2*a* in the inner bucket 2, and the scraping port 001*b* corresponds to the scraping area 2*b* in the inner bucket 2.

In other embodiments, the outer barrel 1 can also be independently arranged into two buckets, the clean water area 1*b* is located in one bucket, the sewage area 1*c* is located in other bucket, one bucket is provided with a bottom support, the other bucket is arranged on the bottom support, and the cover body component 001 is covered on the two buckets.

The flat mop comprises a mop head and a mop rod rotationally installed on the end face of the mop head (the flat mop is not shown in the drawings for the specification); the mop head is arranged vertically when the flat mop is cleaned and dewatered by the mop bucket, that is, the mop head is basically parallel to the mop rod; the mop head is first inserted from the cleaning port 001*a* to the cleaning area 2*a*; the mop head acts on the water supply component 002 for water supply during insertion; the mop head is separated from the cleaning area 2*a* and the cleaning port 001*a* after cleaning, and then inserted into the scraping area 2*b* from the scraping port 001*b*, thereby realizing scraping; the sewage scraped from the mop head can flow into the sewage area 1*c*.

As shown in FIG. 2 to FIG. 5 and FIG. 9 to FIG. 11, a groove 2*c* is arranged at the bottom depression of the inner bucket 2 and can store a small amount of sewage partially dropped during cleaning and scraping of the flat mop head; the width of the groove 2*c* is smaller than that of the mop head; the groove 2*c* can effectively limit the mop head from being inserted to the bottom and avoid touching the sewage in the groove 2*c* during cleaning or dewatering to avoid the secondary pollution of the mop head.

In other embodiments, a plurality of convex ribs can also be arranged at the bottom of the inner bucket 2 to limit the flat mop head to touch the bottom sewage.

A drainage port I 1*d* is arranged on one side of the sewage area 1*c*, and a drainage port III 2*d* is arranged on the same side of the inner bucket 2; when the inner bucket 2 is placed in the sewage area 1*c* of the outer bucket 1, the drainage port I 1*d* is aligned with the drainage port III 2*d*, and the locating plug 4 is inserted into the drainage port I 1*d* and the drainage port III 2*d* successively from the outer bucket 1; to avoid water leakage, waterproof rings (not shown in the drawings for the specification) are arranged on the locating plug 4, two waterproof rings are arranged along the insertion direction of the locating plug 4, one waterproof ring is compatible with the drainage port I 1*d*, the other waterproof ring is compatible with the drainage port III 2*d*, and the waterproof rings limit water leakage at the drainage port I 1*d* and the drainage port III 2*d*; one waterproof ring can also be arranged.

The drainage port II 1*f* is arranged on the side wall of the clean water area 1*b* for the outer bucket 1 and facilitates to clean and replace the remaining clean water in the clean water area 1*b*; in addition, a water plug 5 is removably installed at the drainage port II 1*f* to limit water leakage at the drainage port II 1*f*.

In order to ensure the locating effect of the inner bucket 2 when being placed in the sewage area 1*c* of the outer bucket 1, a pipe wall 1*e* extended into the sewage area 1*c* is provided at the drainage port I 1*d* of the outer bucket 1, a convex wall 2*e* extended outward is provided at the drainage port I 1*d* of the inner bucket 2 and can be mounted on the pipe wall 1*e*; preferably, the pipe wall 1*e* can adopt a pipe body structure, and the convex wall 2*e* can adopt a curved structure, i.e. local pipe body structure.

As the groove 2*c* is arranged in the inner bucket 2, and the wall thickness of the inner bucket 2 usually keeps consistent, a concave 2*f* is formed at the bottom outside the inner bucket 2. In the embodiment, the concave 2*f* is arranged in the middle of the inner bucket 2, that is, the concave 2*f* is located on both sides of the outer wall of the groove 2*c*, a step 1*g* which can be inserted into the concave 2*f* protrudes at the bottom in the sewage area 1*c* of the outer bucket 1, and is inserted into the concave 2*f* when the inner bucket 2 is placed in the sewage area 1*c* of the outer bucket 1, and the convex wall 2*e* is mounted on the pipe wall 1*e*, so that the inner bucket 2 can be placed accurately and stably in the outer bucket 1.

A circle of flange 2*g* is arranged at the upper edge of the inner bucket 2, and the flange 2*g* near the baffle plate 1*a* can be mounted on the baffle plate 1*a*.

As shown in FIG. 4 to FIG. 8 and FIG. 13, the cover body component 001 comprises an upper cover 6, a bottom plate 7, a water retaining cover 8 and a scraping plate 9, wherein the upper cover 6 and the outer bucket 1 can be removably installed through a buckle structure, the bottom plate 7 is fixed under the upper cover 6, and the cleaning port 001*a* and the scraping port 001*b* run through the upper cover 6 and the bottom plate 7. In the embodiment, the cleaning port 001*a* and the scraping port 001*b* are independently arranged, two avoidance ports 001*e* run through the cover body component 001, one avoidance port 001*e* is connected to the cleaning port 001*a*, and the other avoidance port 001*e* is connected to the scraping port 001*b*, the water retaining cover 8 is installed above the upper cover 6 and located on one side of the cleaning port 001*a*, a sliding chute 7*a* is arranged on both sides of the bottom plate 7, and the scraping plate 9 is connected with the sliding chute 7*a* in a sliding way and is locally extended to the scraping port 001*b*.

Preferably, a water filling port 6*c* runs through the upper cover 6 to facilitate water filling into the clean water area 1*b* of the outer bucket 1.

To ensure that the mop head acts on the water supply component 002 when the mop head is inserted into the cleaning port 001*a*, the water supply component 002 can wet the mop head with water from the clean water area 1*b*, and the cleaning port 001*a* is located between the scraping port 001*b* and the clean water area 1*b*, that is, the cleaning area 2*a* is located between the scraping area 2*b* and the clean water area 1*b*; to prevent water in the cleaning area 2*a* from splashing into the clean water area 1*b*, a lower edge 7*d* extended downward is arranged on the inner wall of the cleaning port 001*a* of the bottom plate 7 near the cleaning area 2*a*, and the lower end of the lower edge 7*d* is lower than the baffle plate 1*a* in the outer bucket 1.

A connecting pipe 6*a* connected to the water supply component 002 is arranged under the upper cover 6, the water supply component 002 supplies water through the connecting pipe 6*a*, a water guide plate 6*b* located in the cleaning port 001*a* is arranged on the upper cover 6, the water retaining cover 8 is installed on the water guide plate 6*b*, a cavity 001*c* is formed between the water retaining cover 8 and the water guide plate 6*b*, the connecting pipe 6*a* is connected with the cavity 001*c*, a tooth plate part 7*b* located in the cleaning port 001*a* is arranged on the bottom plate 7 and can scrape materials sticking on the mop head, a plurality of through holes 8*a* are arranged on the water retaining cover 8, and water in the cavity 001*c* can flow into the cleaning port 001*a* from the through holes 8*a* along the water guide plate 6*b*; in order to further increase the uniformity of water flowing into the cleaning port 001*a*, an intercepting strip 6*d* protrudes in the cavity 001*c*, the water guide plate 6*b* is located on one side of the intercepting strip 6*d* close to the cleaning port 001, and the water guide plate 6*b* and the intercepting strip 6*d* are connected; a plurality of water guide channels are formed between the water guide plates 6*b*; when the water level in the cavity 001*c* is higher than the intercepting strip 6*d*, the overflowing water can enter all the water guide channels at the same time.

A water guiding chute 001*d* is formed between the bottom plate 7 and the top cover 6; when the mop head is inserted through the scraping port 001*b*, the mop head exerts downward pressure on the scraping plate 9, and the bottom plate 7 supports the scraping plate 9, that is, the scraping plate 9 scrapes and cleans the mop head, the sewage and dirt scraped by the scraping plate 9 from the mop head flows into the water guide chute 001*d* along the scraping plate 9; a drain outlet 7*c* is arranged on the bottom plate 7 and is connected with the water guide chute 001*d* and the sewage area 1*c*.

When the mop head is lifted, the mop head can drive the scraping plate 9 to slide due to the sliding connection between the scraping plate 9 and the bottom plate 7; preferably, the sliding chute 7*a* is obliquely arranged, the upper end of the sliding chute 7*a* is further away from the scraping port 001*b* than the lower end, so that when the scraping plate 9 slides upwards along the sliding chute 7*a*, the scraping plate 9 stays away from the scraping port 001*b*, and the scraping port 001*b* has reduced scraping effect or even no scraping effect on the mop head.

In order to prevent the sewage and dirt scraped by the scraping plate 9 from flowing into the inner bucket 2, and an avoidance part 2*h* is arranged on the inner bucket 2 and can ensure that the sewage flowing from the drain outlet 7*c* and the sewage flowing into the sewage area 1*c* of the outer bucket 1.

In order to facilitate the flat mop to be directly inserted into the scraping port 001*b* for scraping after being removed from the cleaning port 001*a*, the avoidance port 001*e* is arranged on the same side of the cleaning port 001*a* as the scraping port 001*b*.

As shown in FIG. 6 to FIG. 8 and FIG. 12, the water supply component 002 comprises a double-barrel pipe fitting 10, a check valve I 11, a check valve II 12, a piston 13, a pull rod 14 and a gear set 01, wherein the double-barrel pipe fitting 10 is a pipe body I 10*a*, a pipe body II 10*b* and a bottom pipe 10*c* arranged at the lower end of the pipe body I 10*a* and the pipe body II 10*b*, both the pipe body I 10*a* and the pipe body II 10*b* are connected with the bottom pipe 10*c*, the double-barrel pipe fitting 10 is inserted into the clean water area 1*b* of the outer bucket 1, the pipe body I 10*a* of the double-barrel pipe fitting 10 is connected to the connecting pipe 6*a*, the check valve I 11 is installed at the bottom of the bottom pipe 10*c*, the check valve II 12 is installed in the pipe body I 10*a*, the piston 13 is installed in the pipe body II 10*b* in a sliding way, one end of the pull rod 14 is rotationally connected with the piston 13, the other end thereof is rotationally connected with the gear set 01, and the gear set 01 is fixed on the bottom plate 7.

Preferably, water in the clean water area 1*b* unidirectionally flows from the clean water area 1*b* to the bottom pipe 10*c* through the check valve I 11, and water in the bottom pipe 10*c* unidirectionally flows from bottom pipe 10*c* to the pipe body I 10*a* through the check valve II 12.

A mounting port 2*i* is arranged on the bottom plate 7 and is connected to the cleaning port 001*a*, a fixing part 10*d* is arranged on the double-barrel pipe fitting 10 to prevent the double-barrel pipe fitting 10 from separating from the top cover 6 and can be connected to the outer wall of one side wall of the mounting port 2*i* through screws.

As shown in FIG. 4 to FIG. 7, the gear set 01 comprises a driving gear 15 installed in the mounting port 2*i* and partially exposed to the cleaning port 001*a*, a fixing plate 19 fixed on the outer wall of the other side wall of the mounting port 2*i*, a driven gear 16 rotationally installed between the fixing plate 19 and the bottom plate 7 and rotationally driven by the driving gear 15, an intermediate gear 17 rotationally installed between the fixing plate 19 and the bottom plate 7 and meshed with the driven gear 16 and an eccentric tooth 18 rotationally installed on the fixing plate 19 and meshed with the intermediate gear 17, wherein the eccentric gear 18 is provided with an eccentric shaft 18*a* at the axial end deviating from the rotational mounting axis, and the other end of the pull rod is rotationally connected with the eccentric shaft 18*a*.

The rotational transmission can be realized between the driven gear 16 and the driving gear 15 by a spline shaft or non-circular shaft and hole, and the rotation axis of the driving gear 15, the driven gear 16, the intermediate gear 17 and the eccentric gear 18 is perpendicular to the arrangement direction of the cleaning port 001*a*.

In the embodiment, the lower end face of the mop head can act on the driving gear 15 to rotate by inserting the mop head of the flat mop into the cleaning port 001*a*, the driving gear 15 drives the driven gear 16 to rotate, the driven gear 16, the intermediate gear 17 and the eccentric gear 18 achieves rotational transmission through meshing, and the eccentric shaft 18*a* on the eccentric gear 18 drives the piston 13 to move up and down in the pipe body II 10*b* of the double-barrel pipe fitting 10 in the rotation process.

When the piston 13 moves up in the pipe body II 10*b*, the check valve I 11 is opened, the check valve II 12 is closed, and the water in the clean water area 1*b* enters the bottom pipe 10*c*; when the piston 13 moves down in the pipe body II 10*b*, the check valve I 11 is closed, the check valve II 12 opened, the water in the bottom pipe 10*c* enters the cavity 001*c* along the pipe body I 10*a* and the connecting pipe 6*a*, and the water in the cavity 001*c* flows from the through holes 8*a* to the water guide plate 6*b* and flows into the cleaning port 001*a* to wet the mop head.

Preferably, the number of intermediate gears 17 is odd, so that the downward pressure of the mop head in the cleaning port 001*a* is synchronized with the downward movement of the piston 13 driven by the pull rod 14, and the upward lifting of the mop head in the cleaning port 001*a* is synchronized with the upward movement of the piston 13 driven by the pull rod 14.

In other embodiments, the intermediate gear 17 is cancelled so that the eccentric gear 18 is directly meshed with the driven gear 16.

Embodiment 2

Figure 14:
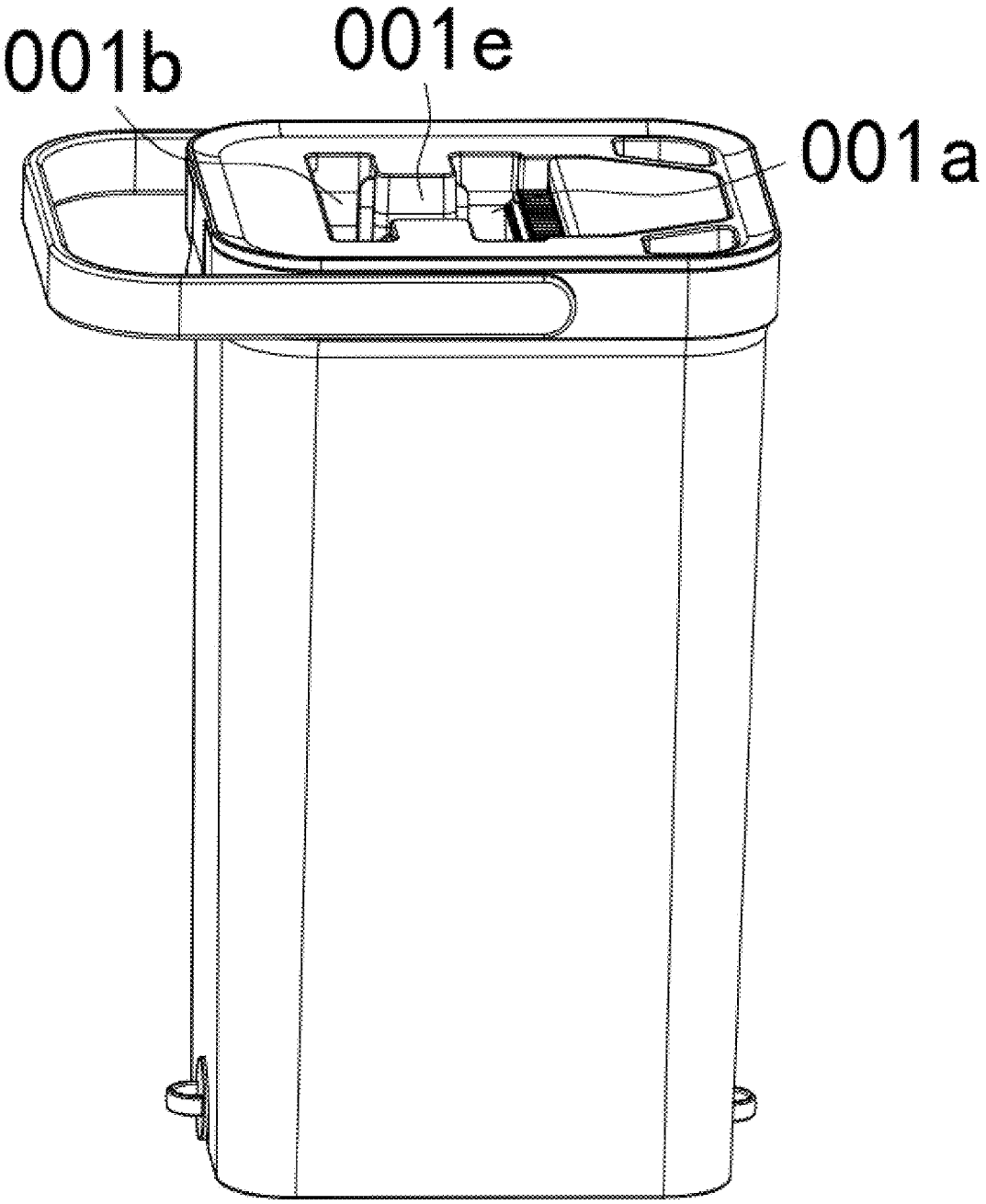
FIG. 14 is the structural diagram for the mop bucket in the preferred embodiment 2 of the invention.
Figure 15:
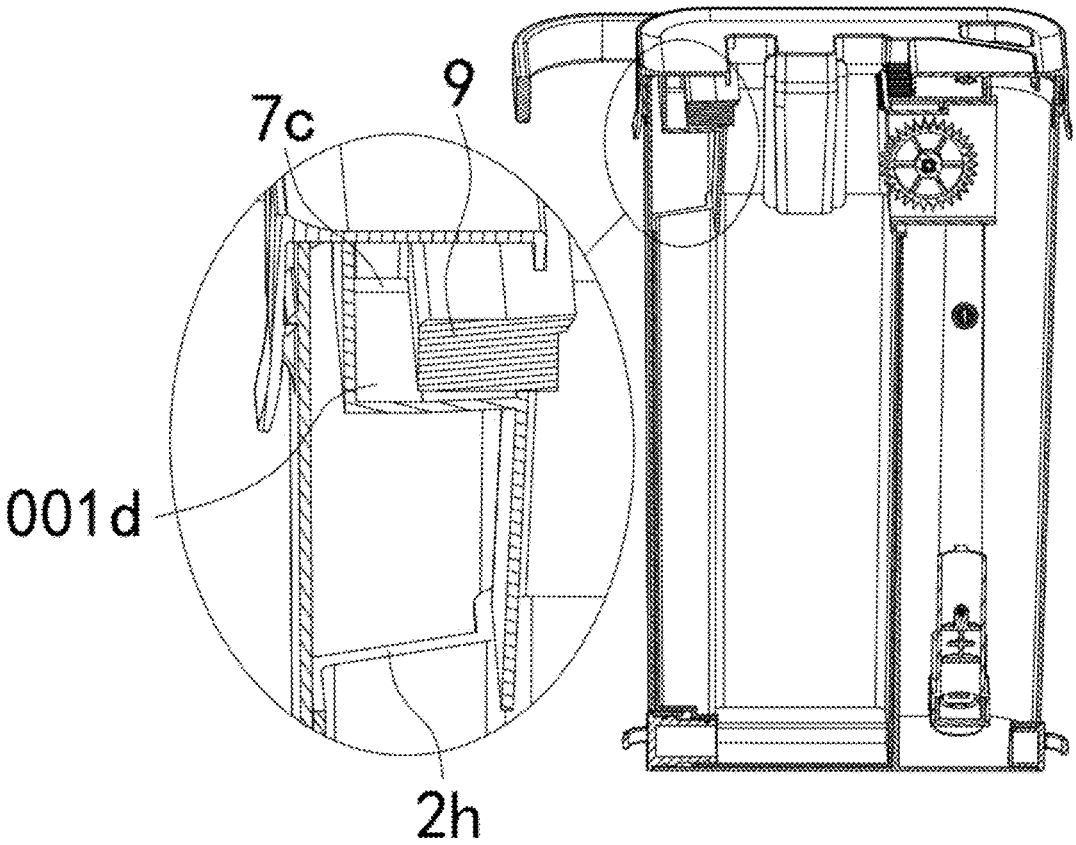
FIG. 15 is the section view for the mop bucket in the preferred embodiment 2 of the invention.
Figure 16:
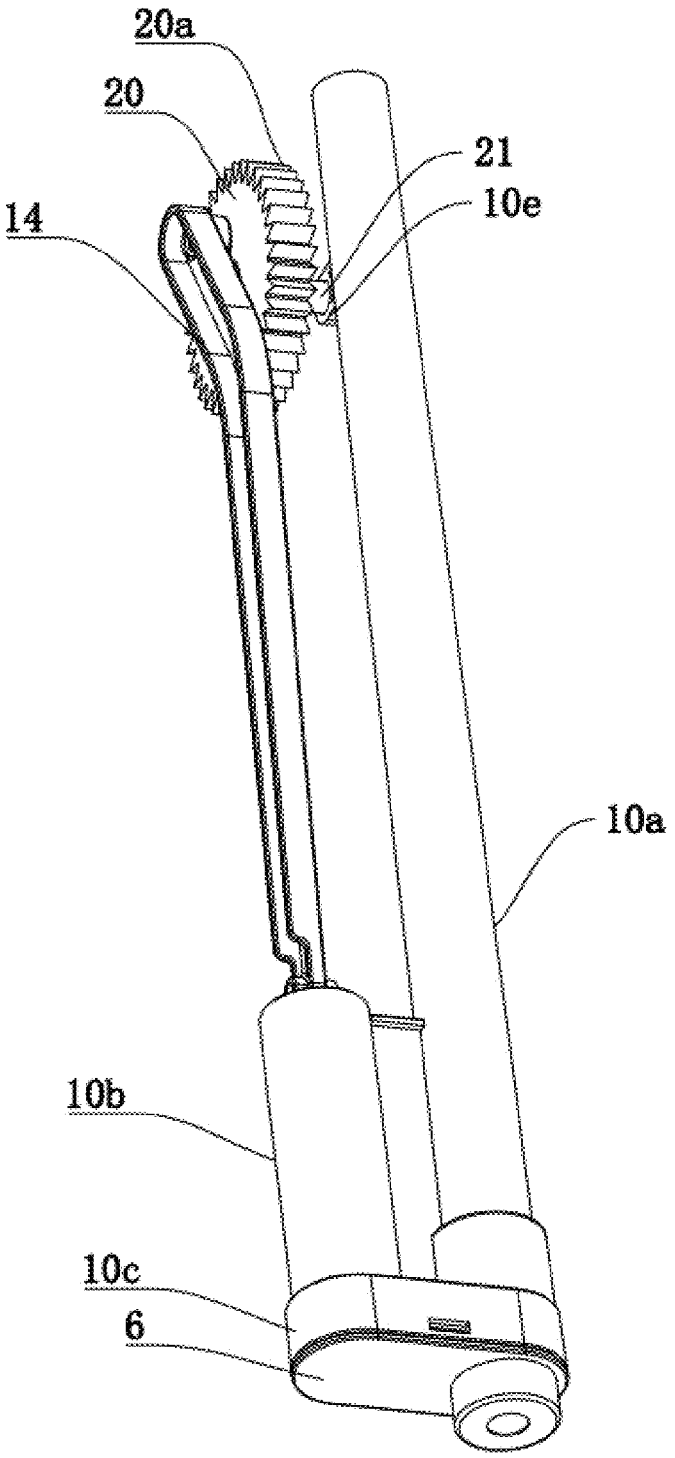
FIG. 16 is the structural diagram of the water supply component in the preferred embodiment 3 of the invention.
Figure 17:
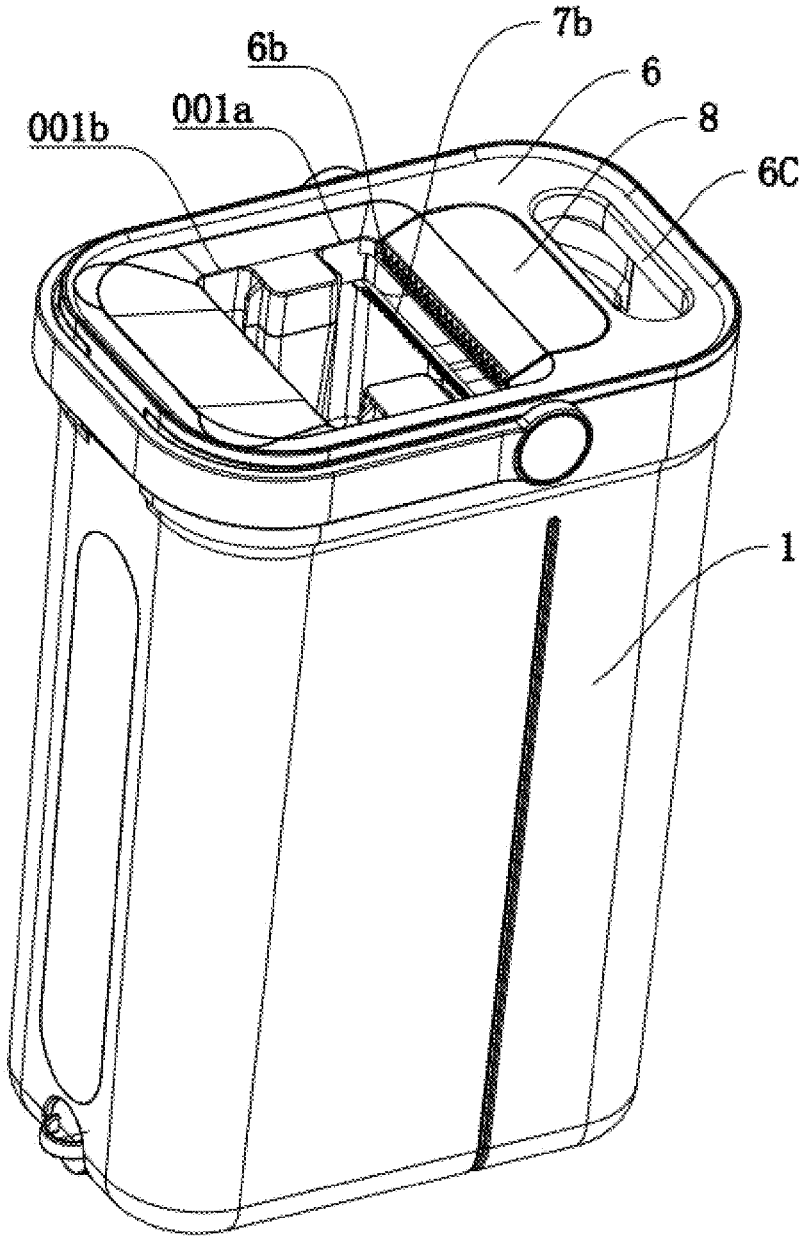
FIG. 17 is the structural diagram for the mop bucket in the preferred embodiment 3 of the invention.
Figure 18:
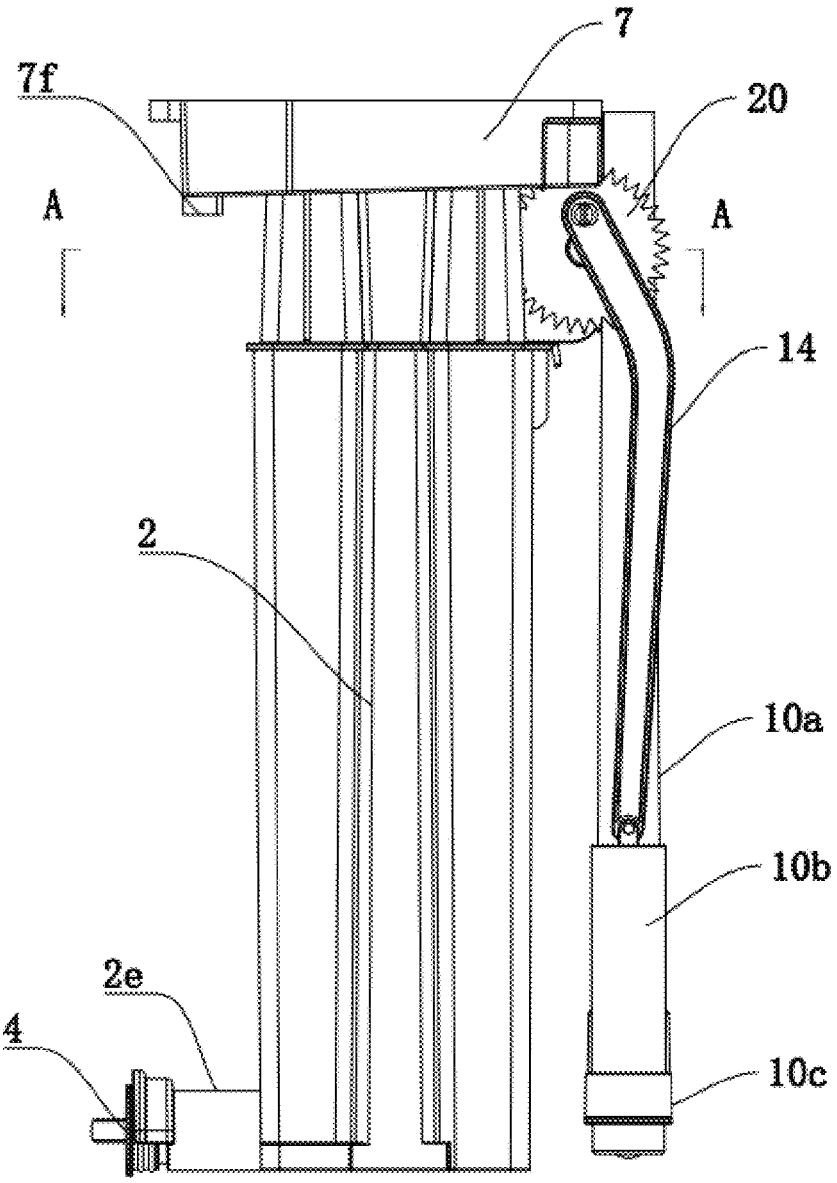
FIG. 18 is the structural diagram 1 for the preferred embodiment 3 of the invention when the cover body component is connected with the water supply component.
Figure 19:
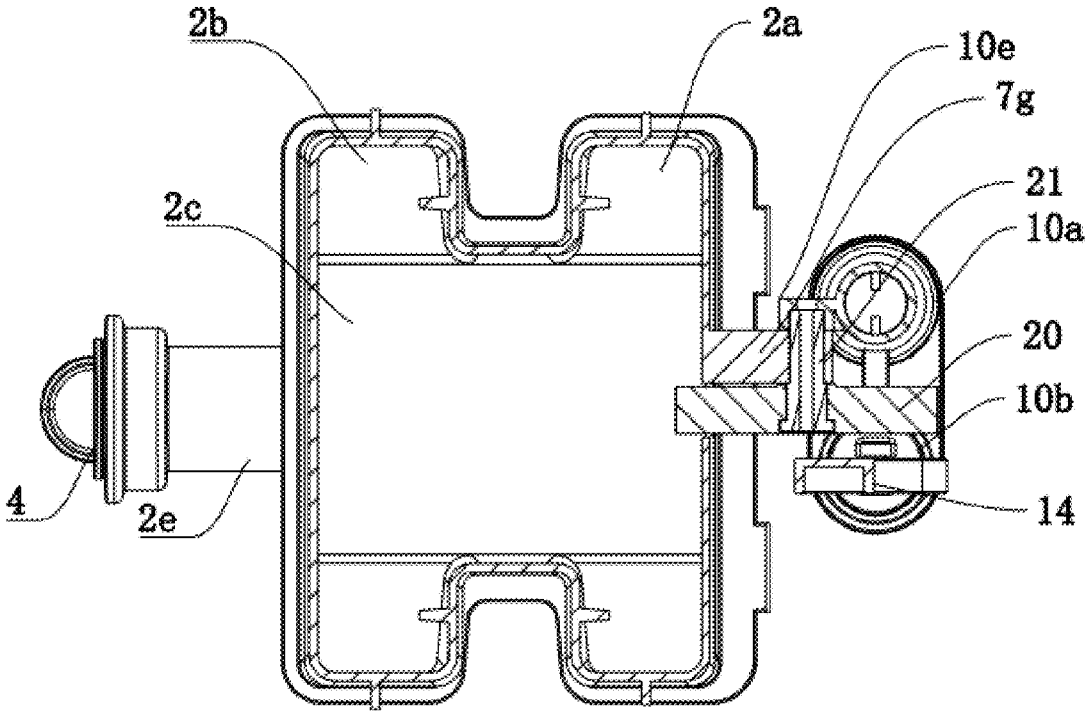
FIG. 19 is the section view for A-A in FIG. 18.
Figure 20:
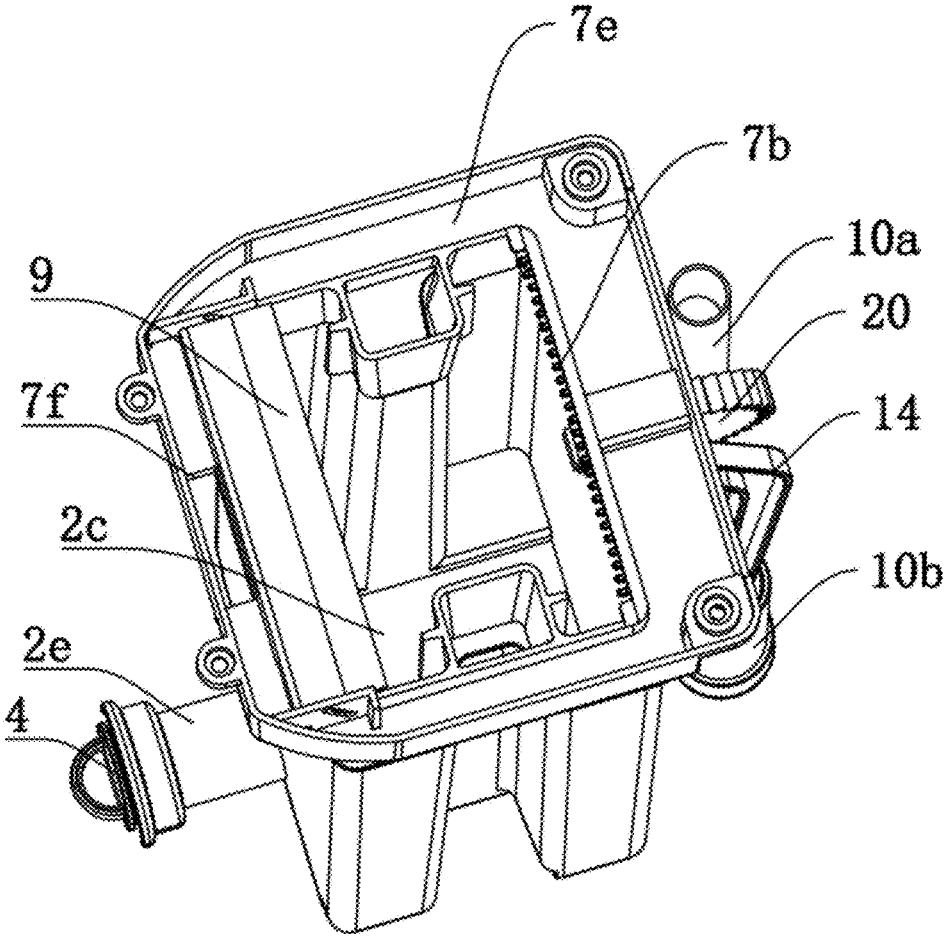
FIG. 20 is the structural diagram 2 for the preferred embodiment 3 of the invention when the cover body component is connected with the water supply component.

As shown in FIG. 14 to FIG. 15, the structural characteristics different from the embodiment 1 are that the cleaning port 001*a* on the cover body component 001 is connected to the scraping port 001*b*, that is, the avoidance port 001*e* connected to the cleaning port 001*a* is the same as that connected to the scraping port 001*e*, and the avoidance port 001*e* is located between the cleaning port 001*a* and the scraping port 001*b*. After being cleaned and removed from the cleaning port 001*a*, the flat mop is required to be rotated by 180 degrees and then inserted into the scraping port 001*b* for scraping.

Embodiment 3

As shown in FIG. 16 to FIG. 21, the structural characteristics different from the embodiment 2 are that the water supply component of the embodiment comprises a double-barrel pipe fitting 10, a check valve I 11, a check valve II 2 12, a piston 13, a pull rod 14 and a friction wheel 20, wherein the double-barrel pipe fitting 10 is provided with a pipe body I 10*a* and a pipe body II 10*b* arranged in parallel and a bottom pipe 10*c* located at the lower end of the pipe body I 10*a* and the pipe body II 10*b*, both the pipe body I 10*a* and the pipe body II 10*b* are connected to the bottom pipe 10*c*, the double-barrel pipe fitting 10 is inserted into the clean water area 1*b* of the outer bucket 1, the pipe body I 10*a* of the double-barrel pipe fitting 10 is connected to the connecting pipe 6*a*, the connecting pipe 6*a* is fixed at the lower end of the top cover 6 and is inserted in the upper end of the pipe body I 10*a* by sealing interference, the check valve I 11 is installed at the bottom of the bottom pipe 10*c* for unidirectional guide of water in the clean water area 1*b* into the bottom pipe 10*c*, the check valve II 12 is installed in the pipe body I 10*a* for unidirectional guide of water in the bottom pipe 10*c* into the pipe body 10*a*, the piston 13 is hermetically installed in the pipe body II 10*b* in a sliding way, one end of the pull rod 14 is connected to the piston 13, and the other end thereof is directly connected to the friction wheel 20 by eccentric rotation.

Friction teeth 20*a* for increasing the friction force are uniformly distributed on the outer ring wall of the friction wheel 20, the friction wheel 20 is simultaneously connected with the outer wall of the bottom plate 7 and the outer wall of the pipe body I 10*a*, a connecting block 7*g* protrudes on the outer wall of the bottom plate 7, a mounting block 10*e* protrudes on the outer wall of the pipe body I 10*a*, a rotating shaft 21 passes through the center hole of the friction wheel 20 and the connecting block 7*g* successively and is fixedly connected with the mounting block 10*e* by interference insertion, riveting or screw joint, etc., and the main body of the friction wheel 20 is located above the clean water area 1*b* and partially located in the cleaning area 2*a*.

A tooth plate part 7*b* and a scraping plate 9 are located on the side opposite to the cleaning area 2*a* and the scraping area 2*b*, a sewage guide ring groove 7*e* is depressed in the circumferential direction of the upper end of the bottom plate, the tooth plate part 7*b* is arranged on the inner wall of the sewage guide ring groove 7*e*, the upper end of the tooth plate part 7*b* is slightly lower than or flush with the opening of the sewage guide ring groove 7*e*, the side of the scraping plate 9 for scraping is located in the scraping area 2*b*, the side far from the scraping area is arranged on the sewage guide ring groove 7*e*, the scraping plate 9 has a slope for guiding the water into the sewage guide ring groove 7*e*, a sewage guide port 7*f* for guiding all sewage into the sewage area 1302 is arranged on the sewage guide ring groove 7*e* and is located at the lower level of the sewage guide ring groove 7*e*, and the sewage guide ring groove 7*e* has the slope for guiding the sewage to the lower level.

Figure 21:
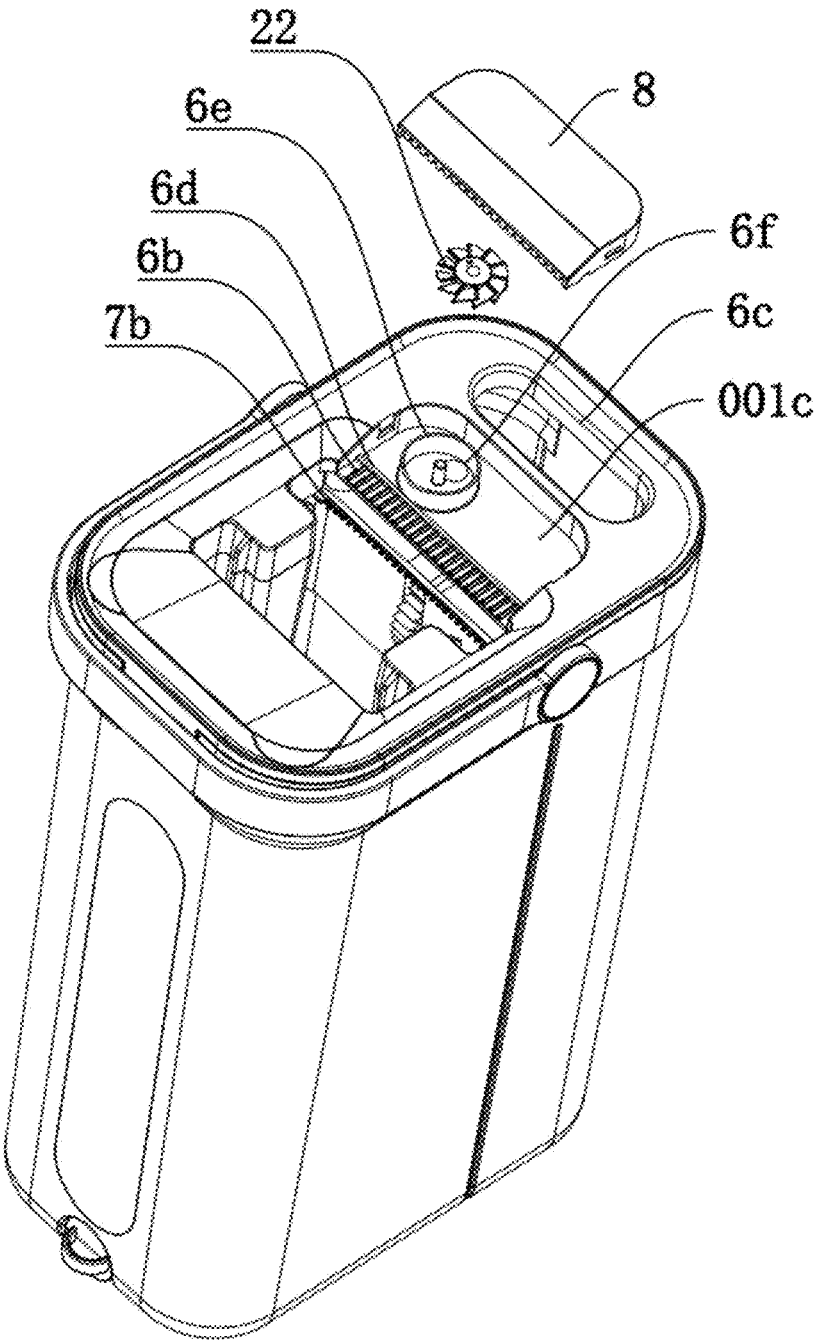
FIG. 21 is the local explosive view for the mop bucket in the preferred embodiment 3 of the invention.

An indicating component for indicating whether the discharge component discharges water is arranged on the top cover 6; as shown in FIG. 21, the indicating component is an indicating impeller 22, a mounting pipe 6*e* protrudes at the bottom of the cavity 001*c*, an outlet hole 6*f* connected with the connecting pipe 6*a* is arranged at the bottom of the mounting pipe 6*e*, the indicating impeller 22 is horizontally and rotationally connected to the mounting pipe 6*e*, and a water baffle 18 is made of transparent material. The user identifies the water level of the water supply component and the clean water area 1*b* by observing the status of the indicating impeller 22. The indicating impeller 22 rotates, indicating that the water supply of the water supply component is normal and the water level of the clean water area 1*b* is reliable; the indicating impeller 22 stops rotating, indicates that the water level in the clean water area 1*b* is too low or the water supply component is faulty, and the user needs to troubleshoot.

The above embodiments are only preferred embodiment of the invention. The protection scope of the invention is not limited to the above embodiments. All technical proposals under the concept of the invention fall within the protection scope of the invention. It should be noted that for ordinary technicians in the technical field, improvements and refinements not divorced from the principle of the invention should be considered as the scope of protection of the invention.

What is claimed is:

1. A double-layer mop bucket for a flat mop comprises an outer bucket (1), an inner bucket (2) arranged in the outer bucket (1) for the flat mop to be inserted, a cover body component (001) removably mounted on the outer bucket (1), and a water supply component (002) mounted on the cover body component (001) and inserted into the outer bucket (1);

a clean water area (1*b*) and a sewage area (1*c*) are arranged in the outer bucket (1), and the inner bucket (2) is removably installed in the sewage area (lc), and the water supply component (002) is inserted into the clean water area (1*b*);

the double-layer mop bucket is characterized in that a cleaning area (2*a*) and a scraping area (2*b*) are arranged in the inner bucket (2), and the cleaning area (2*a*) and the scraping area (2*b*) are connected, and a groove (2*c*) for limiting the flat mop to be inserted into a bottom is arranged at the bottom of the inner bucket (2);

a cleaning port (001*a*) for inserting the flat mop into the cleaning area (2*a*) and a scraping port (001*b*) for inserting the flat mop into the scraping area (2*b*) for scraping are arranged on the cover body component (001), and the flat mop can act on the water supply component (002) for water supply when inserted into the cleaning area (2*a*) from the cleaning port (001*a*);

a water guiding chute (001*d*) is arranged in the cover body component (001), and can guide the water scraped from the flat mop during scrapping to flow into the sewage area (1*c*);

wherein two drainage ports are respectively arranged on a same side of the inner bucket (2) and the outer bucket (1), and a locating plug (4) is inserted into the two drainage ports, and restricts separation of the inner bucket (2) from the outer bucket (1).

2. The double-layer mop bucket for the flat mop according to claim 1, characterized in that a pipe wall (1*e*) extended into the sewage area (1*c*) is arranged at the drainage port of the outer bucket (1), and a convex wall (2*e*) extended outward and capable of being erected on the pipe wall (1*e*) is arranged at the drainage port of the inner bucket (2).

3. The double-layer mop bucket for the flat mop according to claim 1, characterized in that a waterproof ring is installed on the locating plug (4) to restrict the leakage of the two drainage ports.

4. The double-layer mop bucket for the flat mop according to claim 1, characterized in that the cover body component (001) comprises an upper cover (6) and a bottom plate (7) fixedly arranged under the upper cover (6), and the cleaning port (001*a*) and the scraping port (001*b*) run through the upper cover (6) and the bottom plate (7).

5. The double-layer mop bucket for the flat mop according to claim 4, characterized in that a scraping plate (9) capable of scraping the flat mop is arranged or installed on the bottom plate (7) and is partially exposed to the scraping port (001*b*).

6. The double-layer mop bucket for the flat mop according to claim 4, characterized in that the water supply component comprises a double-barrel pipe fitting (10) connected to the upper cover (6) and inserted into the clean water area (1*b*), a gear set (01) mounted on the bottom plate (7) and partially exposed to the cleaning port (001*a*), a pull rod (14) eccentrically rotating and connected with the gear set (01), a piston arranged in the double-barrel pipe fitting (10) in a sliding way and rotationally connected with the pull rod (14), and two check valves installed in the double-barrel pipe fitting (10).

7. The double-layer mop bucket for the flat mop according to claim 6, characterized in that the double-barrel pipe fitting (10) is provided with a pipe body I (10*a*), and a connecting pipe (6*a*) connected with the pipe body I (10*a*) is arranged on the upper cover (6).

8. The double-layer mop bucket for the flat mop according to claim 7, characterized in that the double-barrel pipe fitting (10) is also provided with a bottom pipe (10*c*) and a pipe body II (10*b*), the pipe body I (10*a*) and the pipe body II (10*b*) are arranged in parallel and connected with the bottom pipe (10*c*), the piston (13) is arranged in the pipe body II (10*b*) in a sliding way, one of the two check valves is arranged on the bottom pipe (10*c*), and another check valve of the two check valves is arranged in the pipe body I (10*a*).

9. The double-layer mop bucket for the flat mop according to claim 8, characterized in that a water guide plate (6*b*) located in the cleaning port (001*a*) and the connecting pipe (6*a*) connected with the pipe body I (10*a*) are arranged on the upper cover (6), a water retaining cover (8) is installed on the upper cover (6), a cavity (001*c*) is formed between the water retaining cover (8) and the water guide plate (6*b*), and the connecting pipe (6*a*) is connected with the cavity (001*c*).

10. The double-layer mop bucket for the flat mop according to claim 4, characterized in that the water supply component comprises a drive component and a discharge component, the drive component comprises a friction wheel (20) rotationally arranged and a pull rod (14), the discharge component comprises a double-barrel pipe fitting (10) connected to the upper cover (6) and inserted into the clean water area (1*b*), a piston (13) hermetically slipping into one barrel of the double-barrel pipe fitting (10) and two check valves installed in the double-barrel pipe fitting (10), one end of the pull rod (14) is eccentrically rotated and connected to the friction wheel (20), and another end of the pull rod (14) is hinged with the piston (13).

11. The double-layer mop bucket for the flat mop according to claim 10, characterized in that the friction wheel (20) is locally located in the cleaning area (2*a*), and is driven to rotate and drive the water supply component to supply water when the flat mop matched with the mop bucket is extended into the cleaning area (2*a*).

12. The double-layer mop bucket for the flat mop according to claim 10, characterized in that friction teeth (20*a*) for increasing the friction force are uniformly distributed on an outer ring wall of the friction wheel (20).

13. The double-layer mop bucket for the flat mop according to claim 10, characterized in that the double-barrel pipe fitting (10) is provided with a pipe body I (10*a*), and a connecting pipe (6*a*) connected with the pipe body I (10*a*) is arranged on the upper cover (6).

14. The double-layer mop bucket for the flat mop according to claim 13, characterized in that the double-barrel pipe fitting (10) is also provided with a bottom pipe (10*c*) and a pipe body II (10*b*), the pipe body I (10*a*) and the pipe body II (10*b*) are arranged in parallel and connected with the bottom pipe (10*c*), the piston (13) is arranged in the pipe body II (10*b*) in a sliding way, one of the two check valves is arranged on the bottom pipe (10*c*), and another check valve of the two check valves is arranged in the pipe body I (10*a*).

15. The double-layer mop bucket for the flat mop according to claim 14, characterized in that a water guide plate (6*b*) located in the cleaning port (001*a*) and the connecting pipe (6*a*) connected with the pipe body I (10*a*) are arranged on the upper cover (6), a water retaining cover (8) is installed on the upper cover (6), a cavity (001*c*) is formed between the water retaining cover (8) and the water guide plate (6*b*), and the connecting pipe (6*a*) is connected with the cavity (001*c*).

* * * * *